United States Patent [19]

Welch

[11] 4,020,612

[45] May 3, 1977

[54] LINTEL STRUCTURE

[75] Inventor: William T. Welch, Tucson, Ariz.

[73] Assignee: Smith Pipe and Steel Co., Phoenix, Ariz.

[22] Filed: Oct. 21, 1974

[21] Appl. No.: 516,765

[52] U.S. Cl. ..... 52/731; 52/720; 52/339; 52/672

[51] Int. Cl.[2] ..... E04C 3/30; E04B 1/16

[58] Field of Search ..... 52/720, 85, 204, 730, 52/732, 338, 339, 672, 731, 670, 671

[56] References Cited

UNITED STATES PATENTS

| | | | |
|---|---|---|---|
| 1,588,661 | 6/1926 | Clark | 52/672 |
| 2,125,692 | 8/1938 | Ragsdale et al. | 52/731 |
| 2,239,529 | 4/1941 | Knudsen | 52/204 |
| 2,292,459 | 8/1942 | Martin | 52/204 |
| 2,448,109 | 8/1948 | Michael | 52/731 |

FOREIGN PATENTS OR APPLICATIONS

| | | | |
|---|---|---|---|
| 1,032,706 | 6/1958 | Germany | 52/731 |
| 931,271 | 1963 | United Kingdom | 52/204 |
| 226,911 | 1925 | United Kingdom | 52/731 |
| 869,697 | 1961 | United Kingdom | 52/204 |

*Primary Examiner*—Price C. Faw, Jr.
*Assistant Examiner*—Robert C. Farber
*Attorney, Agent, or Firm*—Herbert E. Haynes, Jr.

[57] ABSTRACT

A lintel fabricated of an elongated lightweight metal plate having rigidifying beam means affixed thereto and extending longitudinally thereof.

8 Claims, 7 Drawing Figures

LINTEL STRUCTURE

BACKGROUND OF THE INVENTION

1. Field of the Invention

This invention relates to an architectural member and more particularly to an elongated lightweight lintel.

2. Description of the Prior Art

As is well known in the art, a lintel is a horizontally disposed architectural member which is employed to span an opening in a building such as a window or door, and the lintel usually carries the load above that opening. The lintels used in modern buildings of cement block, brick, types of masonry construction have traditionally been fabricated of elongated heavy gage angle iron. A pair of such angle members are employed to form a lintel by placement of the members in a back-to-back position over the opening in the building. This positioning results in a pair of juxtaposed upstanding flanges and a pair of oppositely laterally extending flanges. In some instances the pair of upstanding flanges are secured to each other such as by tack welding.

One particular size of angle iron members commonly used in forming the above described prior art lintels will measure 3½ inches per leg, or flange, and are of ¼ inch thick metal. Each angle iron of these dimensions will weigh approximately 5.8 pounds per lineal foot. Other larger angle irons are used when the span and load requirements necessitate the use of such heavier metal. In any event, the increasing cost and general scarcity of such material has resulted in substantial increases in the price that builders must pay for lintels, and has started a search for a lintel design which is less costly, can be made from lighter gage metal, and will have the required structural strength.

One such attempt which failed to meet the various building codes due to inadequate structural strength was simply to form the above described prior art lintel of lighter angle iron. Another attempt which also failed was to fabricate the lintel of an elongated plate assembly consisting of two separate plates welded together with the upper plate having a longitudinally extending upstanding bead formed therein.

Therefore, a need exists for a new and improved lintel structure which can be fabricated from relatively light gage metal and will have sufficient structural strength.

SUMMARY OF THE INVENTION

In accordance with the present invention, a new and useful lightweight lintel structure is disclosed as being fabricated of an elongated relatively light gage metal plate having a rigidifying beam means affixed which extends longitudinally thereof. The rigidifying beam means is disposed intermediate the longitudinal edges of the plate and is upstanding therefrom. The preferred form of rigidifying beam means is a relatively light gage tubular beam either of square or rectangular cross sectional configuration. However, other forms of rigidifying beam means can be employed such as a U-shaped channel, an angle iron member, and the like.

Accordingly, it is an object of the present invention to provide a new and useful lintel structure.

Another object of the present invention is to provide a new and useful lintel structure which is made of light gage metal, is simple to fabricate and has sufficient strength.

Another object of the present invention is to provide a new and useful lintel structure which can be fabricated of light gage materials so that such lintel structures will be readily available at substantially reduced costs.

Another object of the present invention is to provide a new and useful lintel structure of the above described character which is formed of a relatively light gage elongated metal plate having a rigidifying beam means affixed thereto so as to be upstanding therefrom and extend longitudinally thereof.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
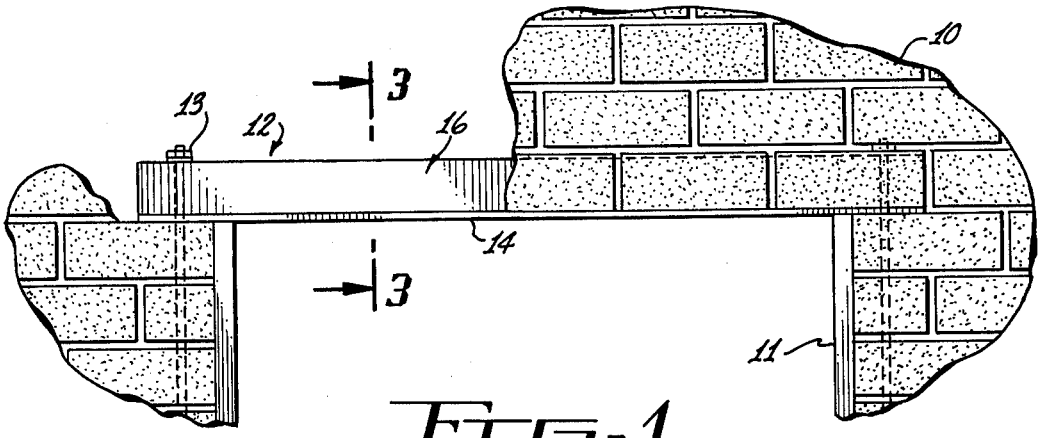
FIG. 1 is a fragmentary elevational view of a building opening having a portion thereof broken away to show the lintel of the present invention.
Figure 2:
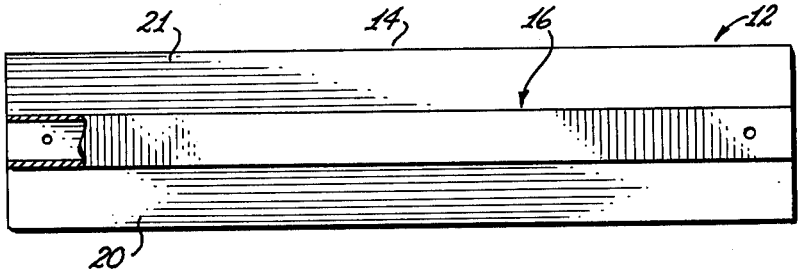
FIG. 2 is a top view of the lintel of the present invention partially broken away to show the various features thereof.
Figure 3:
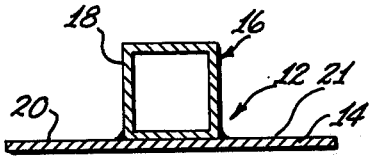
FIG. 3 is an enlarged sectional view taken on the line 3—3 of FIG. 1.
Figure 4:
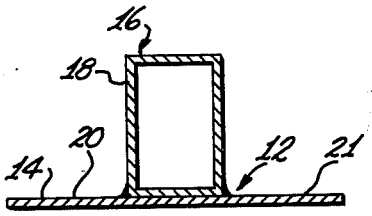
FIG. 4 is a sectional view similar to FIG. 3 and in which a modified form of the lintel of the present invention is shown.

Referring more particularly to the drawing, FIG. 1 illustrates a building structure 10, having a typical opening 11 therein such as of the type commonly employed to form a doorway or a window opening. The lintel structure of the present invention, which is indicated generally by the reference numeral 12, is mounted in the usual manner above the building opening 11 for spanning that opening and carrying the load above.

As is well known in the art, lintels in general are sized so that the opposite ends thereof are supported on the building structure itself immediately adjacent the opening, and the lintel is suitably tied down such as with bolts 13 fixed in the masonry wall.

The lintel structure 12 of the present invention is fabricated of an elongated plate 14 which is sized as to length and width as is customary in the industry, but is of approximately one-half of the usual metal thickness. Heretofore, lintels which were fabricated of, for example, ¼ inch thick or thicker angle iron may be replaced by the lintel structure 12 of the present invention which is fabricated with a plate 14 of ⅛ inch thick metal.

This reduction in metal thickness is made possible, without detrimental effects as to the structural stength of the lintel 12, by the fixed attachment of a rigidifying beam means 16 to one of the planar surfaces of the elongated plate 14. The rigidifying beam means 16 is disposed to extend longitudinally of the plate 14 along a line intermediate the opposite longitudinal edges of the plate. The rigidifying beam means 16 is fixedly attached to the plate 14 such as by welding and is upstanding therefrom.

FIGS, 3 and 4 illustrate the preferred form of the rigidifying beam means 16 of the lintel 12 as being a box shaped tubular beam 18 which may be either of square or rectangular cross sectional configuration. The alternate usage of square of rectangular tubular beam 18 is determined by the span of the lintel 12 and the allowable loads as hereinafter will be explained in detail. The inherent structural strength of the tubular beams 18 provides the lintel 12 with the necessary strength to place the lintel well within the requirements of the building codes as to allowable deflection and the like. Also, the inherent strength characteristics of the tubular beams 18 allows those beams to be fabricated of relatively light gage metal such as 1/16 inch or ⅛ inch.

The use of a particular configuration of the tubular beam 18, i,e., square as opposed to rectangular, and 1/16 inch as opposed to ⅛ inch, is determined by the span and load requirement of the particular lintel. For example, with a given width and thickness of the plate 14, a 2 inch square tubular beam 18 of 1/16 inch metal thickness may be used in a range of spans from approximately 2½ feet to 5½ feet with the allowable loads for those particular spans being 832 pounds per square inch and 95 pounds per square inch, respectively. With the same given plate 14 and a 2 inch square tubular beam 18 of ⅛ inch metal thickness, a range of spans from approximately 4½ feet to 7 feet may be accommodated with the allowable loads respectively, being 282 pounds per square inch and 73 pounds per square inch. A rectangular tubular beam of ⅛ inch thick metal and measuring 3 inches by 2 inches on the same plate 14 is suitable in a range of spans from approximately 5 feet to 8 feet with the allowable loads ranging from 509 pounds per square inch to 133 pounds per square inch. A larger rectangular tubular beam 18 of ⅛ inch thick metal measuring 4 inches by 2 inches and using the same given plate 14, may be used in a range of spans from approximately 6 feet to 9 feet with the allowable loads being between 619 pounds per square inch and 193 pounds per square inch.

It should be noted that the span and loading capabilities as given in the above examples were calculated when those particular configurations of tubular beams 18 were used in conjunction with a plate 14 of ⅛ inch thick metal. Also, it should be noted that changing any one or more of the metal thicknesses or dimensions of the tubular beams 18 and/or of the plate 14 will produce other span and loading capabilities.

The width dimension of the plate 14 of the lintel 12 is normally 7 inches, as is customary in the industry, to accommodate the usual wall thickness of masonary buildings. This width dimension of the plate 14 in turn dictates that the maximum width of the rigidifying beam means 16 must be held within specific limits so that the exposed upper surfaces 20 and 21 of the plate 14, which extend laterally from the beam means, are of sufficient width dimension to accommodate the blocks, bricks, or otherwise, which are carried thereon. This maximum width dimension of the rigidifying beam means 16 is calculated so as to result in each of the surfaces 20 and 21 being at least one-third of the total width of the plate 14.

Therefore, mounting of the tubular beam 18 which is of square cross section may be accomplished by placing any one of the longitudinal surfaces thereof in parallel contiguous engagement with the planar surface of the plate 14 and welding or otherwise affixing that surface to the plate 14. This type of mounting, of course, requires that the width dimension of this square tubular beam 18 does not exceed the above described maximum limit.

Mounting of the tubular beam 18 which is of rectangular cross section may be accomplished by placing either one of the longitudinally extending surfaces which have the smallest width dimension in coextending parallel contiguous engagement with the planar surface of the plate 14 and welding or otherwise affixing that surface to the plate. As before, the width dimension of the surface of the beam 18 which is affixed to the plate 14 must be within the above described limit.

Figure 5:
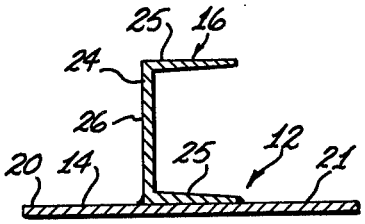
FIG. 5 is a sectional view similar to FIG. 3 which shows another modification of the lintel of the present invention.

FIG. 5 illustrates another type of rigidifying beam means 16 which is a channel member 24 of U-shaped in cross sectional configuration with the usual spaced apart parallel flanges 25 and interconnecting leg 26. Such channels are conventional mill products which, when of sufficient metal thickness for this purpose, are sized so that the distance between the flanges 25 is too great to allow the channel to be mounted so that the interconnecting leg 26 is parallel to the plate 14. If mounted in that fashion, the block or brick supporting capability of the surfaces 20 and 21 of the plate 14 would be lost. Thus, the channel beam 24 is rigidly affixed to the plate 14 by placing one of the flanges 25 in coextending parallel contiguous engagement with the planar surface of the plate and welding that flanges 25 thereto. Once again, the width dimension of the flange 25 must be within the above described limit.

It should be apparent that a U-shaped channel beam (not shown) could be especially fabricated with a sufficiently reduced width dimension to allow the interconnecting leg (not shown) thereof to be parallel to the plate 14.

Figure 6:
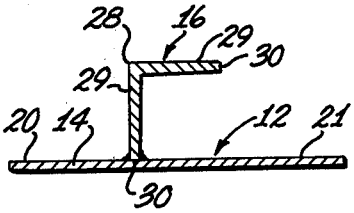
FIG. 6 is a sectional view similar to FIG. 3 which shows another modification of the lintel of the present invention.

FIG. 6 illustrates another form of rigidifying beam means 16 which may be employed in the fabrication of the lintel 12 of the present invention. In this embodiment, the rigidifying beam means 16 is a conventional mill produced angle iron beam 28 mounted so that one of the flanges 29 thereof is normal to the planar surface of the plate 14 and the free edge 30 of that flange is in coextending parallel contiguous engagement with the plate 14. Thus, the other flange 29 and its free edge 30 are spaced from and parallel with the plate 14. In mill produced angle irons having a sufficient metal thickness for this purpose, the distance between the free edges 30 of the flanges 29 is too great to allow that type of angle iron beam to be mounted with both of the free edges 30 fixed to the plate 14. Again, the width dimension of the angle iron beam 28 must be selected so as not to exceed the above described maximum limit. Also, special angle iron members (not shown) could be especially fabricated, such as with a 45° angle rather than the usual 90° angle, to allow affixation of both free edges to the plate 14.

It is preferred that both the channel beam 24 and the angle iron beam 28 be mounted as shown and described above to allow usage of conventionally produced mill products thus reducing the costs associated with specialty items.

Figure 7:
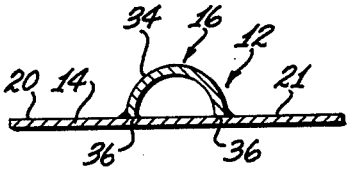
FIG. 7 is a sectional view similar to FIG. 3 which shows still another modification of the lintel of the present invention.

FIG. 7 illustrates another type of rigidifying beam means 16 which is shown as an arcuate in cross section beam 34, which may be formed such as by sawing or otherwise splitting a length of pipe having a suitable diameter and metal thickness. It should be noted that the cross sectional configuration of the arcuate in cross section beam 34 may be semicircular or any other convenient arcuate segment of a circle. Mounting of the arcuate in cross section beam 34 is accomplished by placing the terminal longitudinally extending edges 36 in coextending parallel contiguous engagement with the planar surface of the plate 14 and welding or otherwise affixing those edges to the plate.

While the principles of the invention have now been made clear in illustrated embodiments, there will immediately be obvious to those skilled in the art, many modifications of structure, arrangements, proportions, the elements, materials, and components used in the practice of the invention, and otherwise, which are particularly adapted for specific environments and application requirements without departing from those principles. The appended claims are therefore intended to cover and embrace any such modifications within the limits only of the true spirit and scope of the invention.

What I claim is:

1. A lintel structure comprising:

a. an elongated flat plate; and b. an elongated rigidifying one piece tubular beam of unitary endless cross section fixedly attached to one of the planar surfaces of said elongated flat plate, said elongated rigidifying tubular beam means disposed to extend longitudinally on said elongated flat plate intermediate the opposite longitudinal edges thereof.

2. A lintel structure as claimed in claim 1 wherein saidelongated rigidifying one piece tubular beam means has a width dimension which is less than the width dimension of said elongated plate to expose a portion of the planar surface of said elongated flat plate on each of the opposite sides of said rigidifying tubular beam means.

3. A lintel structure as claimed in claim 1 wherein said elongated rigidifying one piece tubular beam means has a width dimension which is less than the width dimension of said elongated plate to expose a portion of the planar surface of said elongated flat plate on each of the opposite sides of said rigidifying tubular beam means, each of the exposed portions being at least one third of the planar surface of said elongated flat plate.

4. A lintel structure as claimed in claim 1 wherein said elongated rigidifying one piece tubular beam means is a tubular member of box shaped cross sectional configuration.

5. A lintel structure as claimed in claim 1 wherein said elongated rigidifying one piece tubular beam means is a tubular beam of square cross sectional configuration.

6. A lintel structure as claimed in claim 1 wherein said elongated rigidifying one piece tubular beam means is a tubular beam of square cross sectional configuration with one of the surfaces thereof in coextending parallel contiguous engagement with the planar surface of said elongated flat plate and affixed thereto.

7. A lintel structure as claimed in claim 1 wherein said elongated rigidifying one piece tubular beam means is a tubular beam of rectangular cross sectional configuration.

8. A lintel structure as claimed in claim 1 wherein said elongated rigidifying one piece tubular beam means is a tubular beam of rectangular cross sectional configuration with one of the smaller surfaces thereof in coextending parallel contiguous engagement with the planar surface of said elongated flat plate and affixed thereto.

* * * * *